US010208631B2

(12) United States Patent
Baik et al.

(10) Patent No.: US 10,208,631 B2
(45) Date of Patent: Feb. 19, 2019

(54) POWER GENERATION SYSTEM USING EJECTOR REFRIGERATION CYCLE

(71) Applicant: KOREA INSTITUTE OF ENERGY RESEARCH, Daejeon (KR)

(72) Inventors: Young Jin Baik, Daejeon (KR); Jun Hyun Cho, Daejeon (KR); Gil Bong Lee, Daejeon (KR); Ho Sang Ra, Daejeon (KR); Hyung Ki Shin, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 378 days.

(21) Appl. No.: 15/032,056

(22) PCT Filed: Nov. 3, 2015

(86) PCT No.: PCT/KR2015/011709

§ 371 (c)(1),
(2) Date: Apr. 26, 2016

(87) PCT Pub. No.: WO2016/182150

PCT Pub. Date: Nov. 17, 2016

(65) Prior Publication Data

US 2018/0195417 A1 Jul. 12, 2018

(30) Foreign Application Priority Data

May 8, 2015 (KR) ..... 10-2015-0064301

(51) Int. Cl.
*F01K 9/00* (2006.01)
*F01K 19/10* (2006.01)
*F01K 17/02* (2006.01)
*F01K 23/04* (2006.01)

(52) U.S. Cl.
CPC ..... *F01K 19/10* (2013.01); *F01K 9/00* (2013.01); *F01K 17/02* (2013.01); *F01K 23/04* (2013.01)

(58) Field of Classification Search
CPC ..... F01K 17/02; F01K 19/10; F01K 23/04; F01K 9/00; F03G 7/05
See application file for complete search history.

(56) References Cited

U.S. PATENT DOCUMENTS

2012/0255304 A1* 10/2012 Li ..... F01K 17/02 60/670
2017/0058708 A1* 3/2017 Noureldin ..... F01K 21/005

FOREIGN PATENT DOCUMENTS

JP 60017232 A * 1/1985 ..... F02C 7/143
KR 10-2011-0121110 A 11/2011
KR 10-1431133 * 8/2014 ..... F03G 7/04

* cited by examiner

*Primary Examiner* — Laert Dounis
*Assistant Examiner* — Matthew T Largi
(74) *Attorney, Agent, or Firm* — Revolution IP, PLLC

(57) ABSTRACT

The present invention drives an ejector refrigeration unit using waste heat, such as a combustion gas generated from the outside, etc., and cools a working fluid sucked into a compressor in a power generator using the working fluid that circulates in the ejector refrigeration unit, thereby reducing a compression work of the compressor so that efficiency of a system can be improved.

11 Claims, 4 Drawing Sheets

[Fig.1]
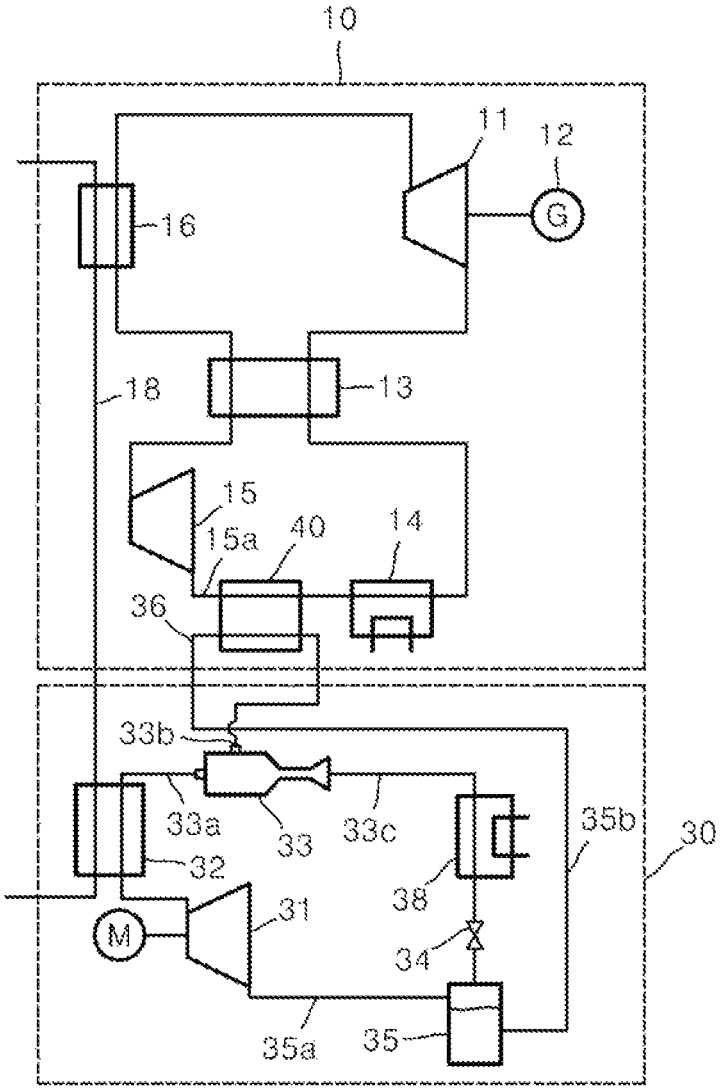

[Fig.2]
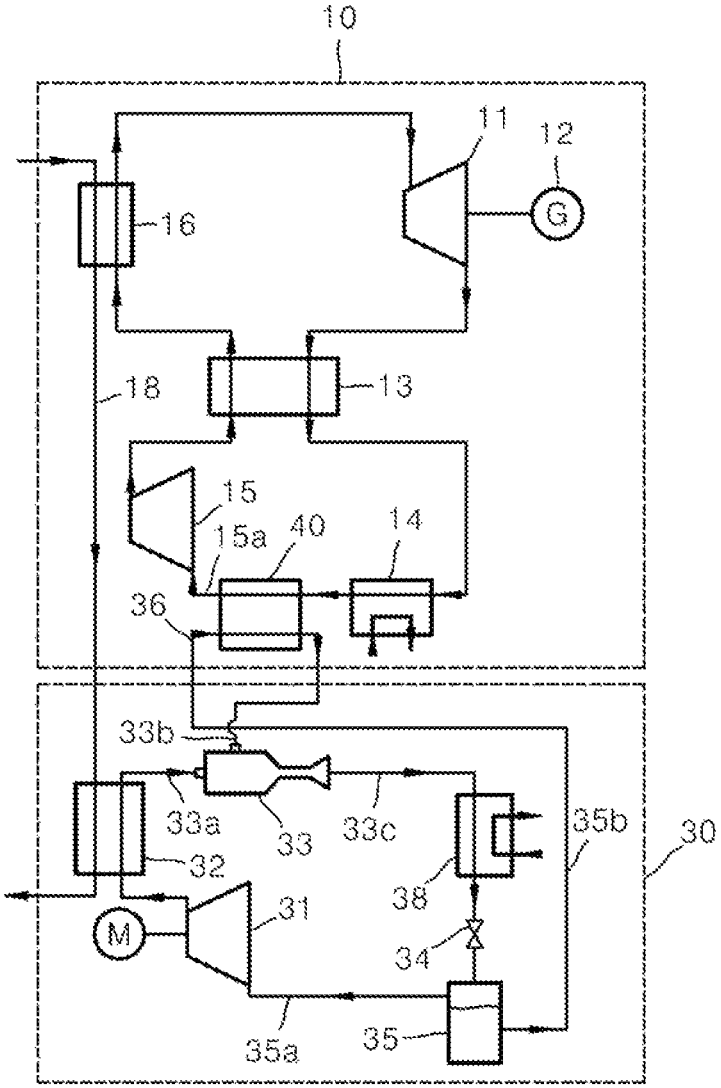

[Fig.3]
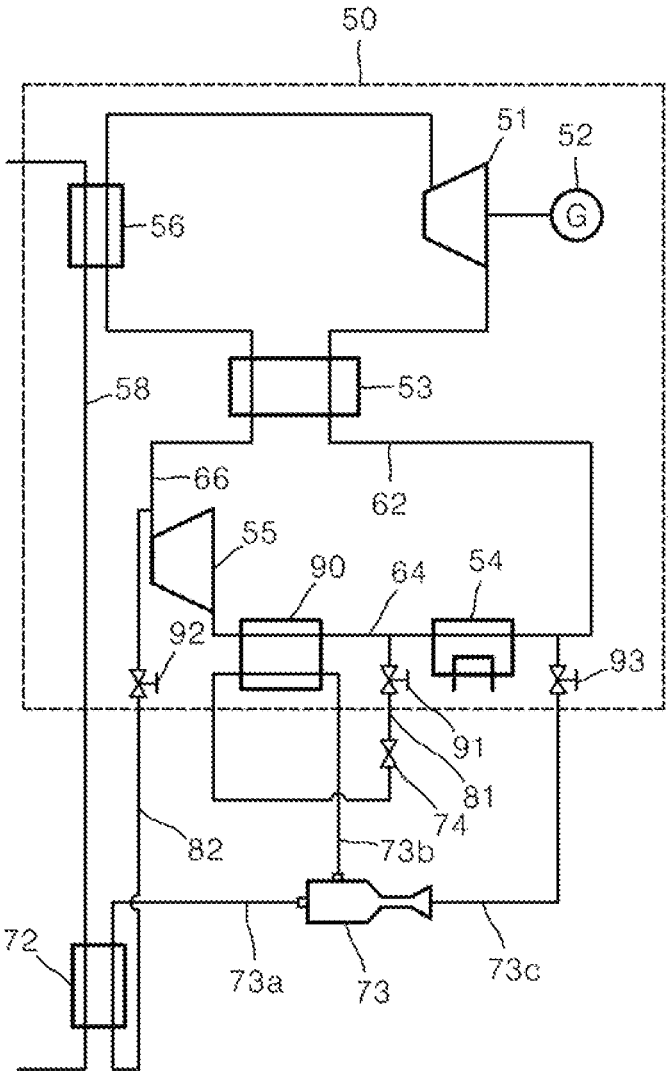

[Fig.4]
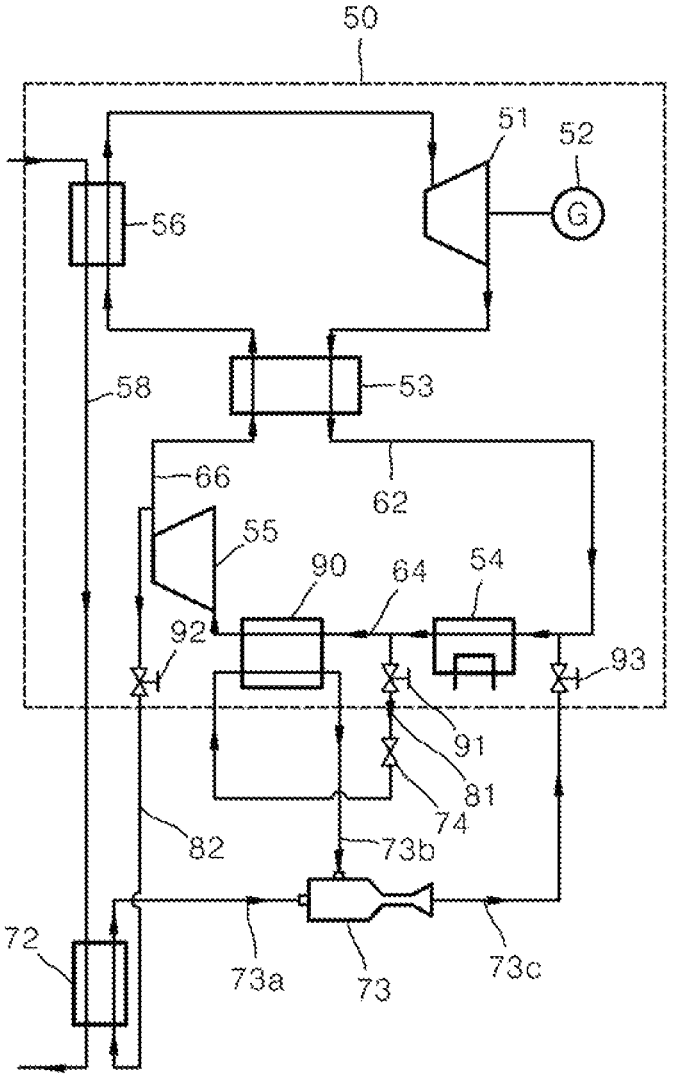

POWER GENERATION SYSTEM USING EJECTOR REFRIGERATION CYCLE

CROSS REFERENCE TO PRIOR APPLICATIONS

This application is a National Stage Application of PCT International Patent Application No. PCT/KR2015/011709 filed on Nov. 3, 2015, under 35 U.S.C. § 371, which claims priority to Korean Patent Application No. 10-2015-0064301 filed on May 8, 2015, which are all hereby incorporated by reference in their entirety.

TECHNICAL FIELD

The present invention relates to a power generation system using an ejector refrigeration cycle, and more particularly, to a power generation system using an ejector refrigeration cycle that can improve efficiency by driving the ejector refrigeration cycle using waste heat and cooling a working fluid introduced into a compressor using the ejector refrigeration cycle.

BACKGROUND ART

There is continuously-growing concern about improvements in high-efficiency power production technology so as to improve the utility of existing energy sources and efficiency of power demand and supply. As an alternative for improving high-efficiency power production technology, research and development for a regenerative Brayton cycle have been briskly carried out.

However, in the conventional regenerative Brayton cycle, a working fluid introduced into a heater is heated using a heat source, such as a combustion gas discharged from a turbine, etc. Nevertheless, there is a problem that waste heat is not sufficiently used and is discarded.

DETAILED DESCRIPTION OF THE INVENTION

Technical Problem

The present invention provides a power generation system using an ejector refrigeration cycle that can further improve efficiency.

Technical Solution

According to an aspect of the present invention, there is provided a power generation system using an ejector refrigeration cycle, the power generation system including: a power generator including a turbine driven by a first working fluid heated by a heater, a regenerator that recovers heat of the first working fluid discharged from the turbine and delivers the recovered heat to the first working fluid introduced into the heater, a first cooler that cools the first working fluid discharged from the regenerator, and a first pressurizing module that pressurizes the first working fluid discharged from the first cooler, wherein the turbine, the regenerator, the first cooler, and the first pressurizing module are connected to one another via a first flow path; an ejector refrigeration unit including a second pressurizing module, an ejector that sucks and injects a second working fluid pressurized by the second pressurizing module, a second cooler that cools the second working fluid discharged from the ejector, and a gas-liquid separator that separates a refrigerant discharged from the second cooler into a refrigerant in a liquid phase state and a refrigerant in a gas phase state, wherein the second pressurizing module, the ejector, the second cooler, and the gas-liquid separator are connected to one another via a second flow path in which the second working fluid circulates; and a cooling unit configured to supply the second working fluid in the liquid phase state separated by the gas-liquid separator to a suction side of the first pressurizing module so as to cool the first working fluid sucked into the first pressurizing module.

According to another aspect of the present invention, there is provided a power generation system using an ejector refrigeration cycle, the power generation system including: a heater configured to heat a first working fluid; a turbine driven by the first working fluid heated by the heater; a regenerator configured to recover heat of the first working fluid discharged from the turbine and to deliver the recovered heat to the first working fluid introduced into the heater; a cooler configured to cool the first working fluid discharged from the regenerator; a first pressurizing module configured to pressurize at least a part of the first working fluid discharged from the cooler; a first bypass flow path formed to bypass a remaining part of the first working fluid discharged from the cooler via the first bypass flow path; an expander installed on the first bypass path and configured to expand the first working fluid bypassed via the first bypass flow path; a heat exchanger for cooling installed between a cooler ejection flow path that connects the cooler and the first pressurizing module and the first bypass flow path, configured to perform a heat-exchanging operation of the first working fluid discharged from the cooler and sucked into the first pressurizing module and a whole of the first working fluid expanded by the expander, and to cool a whole of the first working fluid sucked into the first pressurizing module; a second bypass flow path formed to bypass a part of the first working fluid pressurized by and discharged from the first pressurizing module via the second bypass flow path; and an ejector configured to inject the first working fluid bypassed via the second bypass flow path and the first working fluid cooled by and discharged from the heat exchanger for cooling into a suction side of the cooler.

According to another aspect of the present invention, there is provided a power generation system using an ejector refrigeration cycle, the power generation system including: a power generator including a turbine driven by steam heated by a heater, a regenerator that recovers heat of steam discharged from the turbine and delivers the recovered heat to the steam introduced into the heater, a first condenser that cools the steam discharged from the regenerator using coolant, and a pump that pumps water condensed by and discharged from the first condenser, wherein the turbine, the regenerator, the first condenser, and the pump are connected to one another via a first flow path; an ejector refrigeration unit including a compressor that pressurizes a refrigerant, a heat exchanger for heating that performs a heat-exchanging operation of the refrigerant discharged from the compressor and a remaining heat source after the steam is heated by the heater, an ejector that sucks and injects the refrigerant heated by the heat exchanger for heating, a cooler that cools the refrigerant discharged from the ejector using coolant, and a gas-liquid separator that separates the refrigerant discharged from the cooler into a refrigerant in a gas phase state and a refrigerant in a liquid phase state, wherein the compressor, the heat exchanger for heating, the ejector, the cooler, and the gas-liquid separator are connected to one another via a second flow path; a cooling flow path configured to guide the refrigerant in the liquid phase state separated by the gas-liquid separator to a suction side of the pump; a heat exchanger for cooling installed between a suction-side flow path of the pump and the cooling flow path and configured to cool water sucked into the pump using the refrigerant in the liquid phase state that passes through the cooling flow path; and an ejector auxiliary flow path configured to connect the heat exchanger for cooling and the ejector and to guide the refrigerant in the liquid phase state discharged from the heat exchanger for cooling to an auxiliary suction port of the ejector.

According to another aspect of the present invention, there is provided a power generation system using an ejector refrigeration cycle, the power generation system including: a power generator including a turbine driven by carbon dioxide ($CO_2$) heated by a heater, a regenerator that recovers heat of $CO_2$ discharged from the turbine and delivers recovered heat to $CO_2$ introduced into the heater, a first cooler that cools $CO_2$ discharged from the regenerator using coolant, and a first compressor that pressurizes $CO_2$ cooled by the first cooler, wherein the turbine, the regenerator, the first cooler, and the first compressor are connected to one another via a first flow path; an ejector refrigeration unit including a second compressor that pressurizes a refrigerant, a heat exchanger for heating that performs a heat-exchanging operation of a remaining heat source after $CO_2$ is heated by the heater and the refrigerant discharged from the second compressor, an ejector that sucks and injects the refrigerant heated by the heat exchanger for heating, a second cooler that cools the refrigerant discharged from the ejector using coolant, and a gas-liquid separator that separates the refrigerant discharged from the second cooler into a refrigerant in a gas phase state and a refrigerant in a liquid phase state, wherein the second compressor, the heat exchanger for heating, the ejector, the second cooler, and the gas-liquid separator are connected to one another via a second flow path; a cooling flow path configured to guide the refrigerant in the liquid phase state separated by the gas-liquid separator to a suction side of the first compressor; a heat exchanger for cooling installed between a suction-side flow path of the first compressor and the cooling flow path and configured to cool $CO_2$ sucked into the first compressor using the refrigerant in the liquid phase state that passes through the cooling flow path; and an ejector auxiliary flow path configured to connect the heat exchanger for cooling and the ejector and to guide the refrigerant in the liquid phase state discharged from the heat exchanger for cooling to an auxiliary suction port of the ejector.

According to another aspect of the present invention, there is provided a power generation system using an ejector refrigeration cycle, the power generation system including: a heater configured to heat steam; a turbine driven by steam heated by the heater; a regenerator configured to recover heat of the steam discharged from the turbine and to deliver the recovered heat to steam introduced into the heater; a condenser configured to condense the steam discharged from the regenerator using coolant; a pump configured to pump water discharged from the condenser; a first bypass flow path formed to bypass a part of water discharged from the condenser via the first bypass flow path; an expander installed on the first bypass flow path and configured to expand water bypassed via the first bypass flow path; a heat exchanger for cooling installed between the first bypass flow path and a suction-side flow path of the pump and configured to cool water sucked into the pump using water discharged from the expander; a second bypass flow path formed to bypass a part of water pumped by the pump via the second bypass flow path; an ejector configured to inject water bypassed via the second bypass flow path and water cooled by and discharged from the heat exchanger for cooling into a suction side of the condenser; a heating flow path configured to supply a remaining heat source after the steam is heated by the heater, to a suction side of the ejector; and a heat exchanger for heating installed between the heating flow path and the second bypass flow path and configured to supply the heat source of the heating flow path to water supplied into the suction side of the ejector via the second bypass flow path.

According to another aspect of the present invention, there is provided a power generation system using an ejector refrigeration cycle, the power generation system including: a heater configured to heat $CO_2$; a turbine driven by $CO_2$ heated by the heater; a regenerator configured to recover heat of $CO_2$ discharged from the turbine and to deliver recovered heat to $CO_2$ introduced into the heater; a cooler configured to cool $CO_2$ discharged from the regenerator using coolant; a compressor configured to pressurize $CO_2$ discharged from the cooler; a first bypass flow path formed to bypass a part of $CO_2$ discharged from the cooler via the first bypass flow path; an expander installed on the first bypass flow path and configured to expand $CO_2$ bypassed via the first bypass flow path; a heat exchanger for cooling installed between the first bypass flow path and a suction-side flow path of the compressor and configured to cool $CO_2$ sucked into the compressor using $CO_2$ discharged from the expander; a second bypass flow path formed to bypass a part of $CO_2$ pressurized by the compressor via the second bypass flow path; an ejector configured to inject $CO_2$ bypassed via the second bypass flow path and $CO_2$ cooled by and discharged from the heat exchanger for cooling into a suction side of the cooler; a heating flow path configured to supply a remaining heat source after $CO_2$ is heated by the heater, to a suction side of the ejector; and a heat exchanger for heating installed between the heating flow path and the second bypass flow path and configured to supply the heat source of the heating flow path to $CO_2$ supplied into the suction side of the ejector via the second bypass flow path.

Effect of the Invention

The present invention drives an ejector refrigeration unit using waste heat, such as a combustion gas, etc., and cools a working fluid sucked into a compressor in a power generator using the working fluid that circulates in the ejector refrigeration unit, thereby reducing a compression work of the compressor so that efficiency of a system can be improved.

DESCRIPTION OF THE DRAWINGS

FIG. 1 is a view of a configuration of a power generation system according to an embodiment of the present invention.

FIG. 2 is a view of an operating state of the power generation system illustrated in FIG. 1.

FIG. 3 is a view of a configuration of a power generation system according to another embodiment of the present invention.

FIG. 4 is a view of an operating state of the power generation system illustrated in FIG. 3.

MODE OF THE INVENTION

Hereinafter, embodiments of the present invention will be described with reference to the attached drawings.

FIG. 1 is a view of a configuration of a power generation system according to an embodiment of the present invention. FIG. 2 is a view of an operating state of the power generation system illustrated in FIG. 1.

Referring to FIGS. 1 and 2, a power generation system using an ejector refrigeration cycle according to an embodiment of the present invention includes a power generator 10, an ejector refrigeration unit 30, a cooling unit, and a heat source supply unit.

A heater 16, a turbine 11, a regenerator 13, a first cooler 14, and a first pressurizing module of the power generator 10 are connected to one another via a flow path in which a first working fluid circulates. One of steam, carbon dioxide ($CO_2$), and air may be used as the first working fluid. In the current embodiment, an example in which the first working fluid is $CO_2$, will be described.

The heater 16 is a heat exchanger that heats $CO_2$ using a heat source, such as a combustion gas generated from the outside. The combustion gas is primarily used as a heat source of the power generator 10 using the heater 16, and the heat source of the combustion gas that has passed through the heater 16 is secondarily used as a heat source of the ejector refrigeration unit 30 using a heat exchanger for heating 32 that will be described below. Thus, the heat source of the combustion gas may be utilized as much as possible.

The turbine 11 is driven by $CO_2$ heated by and discharged from the heater 16 and generates a work. The power generator 12 is coaxially connected to the turbine 11.

The regenerator 13 is also called a heat accumulator or recuperator and serves to recover heat of $CO_2$ discharged from the turbine 11 and to heat $CO_2$ introduced into the heater 16. One side of the regenerator 13 is disposed on a flow path that connects the turbine 11 and the first cooler 14, and the other side of the regenerator 13 is disposed on a flow path that connects the first pressurizing module 15 and the heater 16.

The first cooler 14 cools $CO_2$ that has passed through the regenerator 13, using coolant.

The first pressurizing module pressurizes $CO_2$ that has passed through the first cooler 14. Because, in the current embodiment, an example in which $CO_2$ is used as the first working fluid, is described, the first pressurizing module is a first compressor that compresses $CO_2$. However, the present invention is not limited thereto, and when the first working fluid is steam, a pump is used as the first pressurizing module, and a condenser is used as the first cooler 14.

A second pressurizing module, an ejector 33, a second cooler 38, an expander (expansion valve) 34, and a gas-liquid separator 35 of the ejector refrigeration unit 30 are connected to one another via a flow path in which a second working fluid circulates. An example in which a refrigerant is used as the second working fluid, will be described.

A second compressor 31 that pressurizes the second working fluid, is used as the second pressurizing module. A motor is connected to the second compressor 31.

The ejector 33 sucks the refrigerant discharged from the second compressor 31 and injects the sucked refrigerant into the second cooler 38. The ejector 33 sucks the refrigerant that has passed through a heat exchanger for cooling 40 that will be described below, using the refrigerant discharged from the second compressor 31. That is, the ejector 33 injects and supplies the refrigerant discharged from the second compressor 31 and the refrigerant discharged from the heat exchanger for cooling 40 into the second cooler 38. A main suction port, an auxiliary suction port, and an injection port are formed in the ejector 33. An ejector main suction flow path 33*a* is connected to the main suction port of the ejector 33, and an ejector auxiliary suction flow path 33*b* is connected to the auxiliary suction port of the ejector 33, and an ejector injection flow path 33*c* is connected to the injection port.

A condenser that cools the refrigerant injected by the ejector 33 using coolant, may be used as the second cooler 38.

The expansion valve 34 is installed on a flow path that connects the second cooler 38 and the gas-liquid separator 35.

The gas-liquid separator 35 separates the refrigerant that has passed through the expansion valve 34, into a refrigerant in a liquid phase state and a refrigerant in a gas phase state. A gas-phase ejection flow path 35*a* and a liquid-phase ejection flow path 35*b* are connected to the gas-liquid separator 35. The gas-phase ejection flow path 35*a* connects the gas-liquid separator 35 and the second compressor 31 so as to supply the refrigerant in a gas phase state separated by the gas-liquid separator 35 to the second compressor 31. The liquid-phase ejection flow path 35*b* connects the gas-liquid separator 35 and the heat exchanger for cooling 40 so as to connect the refrigerant in a liquid phase state separated by the gas-liquid separator 35 to the heat exchanger for cooling 40.

The cooling unit supplies the refrigerant in the liquid phase state separated by the gas-liquid separator 35 to the power generator 10 so as to cool $CO_2$ sucked into the first compressor 15 of the power generator 10.

The cooling unit includes the heat exchanger for cooling 40 and a cooling flow path 36.

The heat exchanger for cooling 40 is installed on a suction-side flow path 15*a* of the first compressor 15. The heat exchanger for cooling 40 performs a heat-exchanging operation of $CO_2$ discharged from the first cooler 14 and sucked into the first compressor 15 and the refrigerant in the liquid phase state separated by the gas-liquid separator 35 so as to cool $CO_2$ sucked into the first compressor 15.

The heat exchanger for cooling 40 and the ejector 33 are connected to the ejector auxiliary suction flow path 33*b*. The refrigerant heat-exchanged by the heat exchanger for cooling 40 is further sucked into the ejector 33 via the ejector auxiliary suction flow path 33*b*.

The cooling flow path 36 is connected to the liquid-phase ejection flow path 35*b* of the gas-liquid separator 35 and supplies the refrigerant in the liquid phase state separated by the gas-liquid separator 35 to the heat exchanger for cooling 40.

The power generation system further includes a heat source supply unit that supplies a remaining heat source after $CO_2$ is heated by the heater 16, to a suction side of the ejector 33.

The heat source supply unit includes the heat exchanger for heating 32 and a heating flow path 18.

The heat exchanger for heating 32 is installed between the ejector main suction flow path 33*a* and the heating flow path 18 and performs a heat-exchanging operation of the refrigerant discharged from the first compressor 31 and a combustion gas discharged from the heater 16 after $CO_2$ is heated by the heater 16.

The heating flow path 18 connects the heater 16 and the heat exchanger for heating 32 so as to supply the combustion gas discharged from the heater 16 to the heat exchanger for heating 32.

An operation according to an embodiment of the present invention having the above configuration will be described with reference to FIG. 2 as follows.

In the current embodiment, an example in which the first working fluid is $CO_2$ and the second working fluid is a refrigerant, will be described. However, the present invention is not limited thereto. Of course, steam or air, etc. may be used as the first working fluid.

First, $CO_2$ is heated by the heater 16 and then is supplied to the turbine 11. The heater 16 heats $CO_2$ using a heat source, such as a combustion gas generated from the outside.

The heat source discharged from the heater 16 after $CO_2$ is heated by the heater 16, is supplied to the heat exchanger for heating 32 via the heating flow path 18.

The heat exchanger for heating 32 performs a heat-exchanging operation of the heat source and the refrigerant discharged from the second compressor 31 and heats the refrigerant sucked into the ejector 33. The refrigerant sucked into the ejector 33 is heated so that a heat source, such as the combustion gas, may be sufficiently utilized.

Meanwhile, the turbine 11 is driven by $CO_2$ discharged from the heater 16 and generates a work.

A part of heat of $CO_2$ discharged from the turbine 11 is recovered while passing through the regenerator 13.

$CO_2$ that has passed through the regenerator 13 is cooled while passing through the first cooler 14.

$CO_2$ that has passed through the first cooler 14 passes through the heat exchanger for cooling 40. The heat exchanger for cooling 40 performs a heat-exchanging operation of $CO_2$ and the refrigerant in the liquid phase state separated by the gas-liquid separator 35 so that $CO_2$ may be cooled.

Because $CO_2$ sucked into the first compressor 15 may be cooled, a temperature of the suction side of the first compressor 15 is lowered so that a compression work of the first compressor 15 may be reduced.

Thus, when the compression work of the first compressor 15 is reduced, efficiency of the entire system may be improved. Also, because a density of $CO_2$ of an inlet of the compressor is increased, a mass flow rate of the compressor is increased compared to that of a compressor having the same size so that an output of the turbine 11 may be improved.

$CO_2$ that has passed through the heat exchanger for cooling 40, is compressed by the first compressor 15.

$CO_2$ compressed by the first compressor 15 passes through the regenerator 13. The regenerator 13 performs a heat-exchanging operation of $CO_2$ discharged from the first compressor 15 and $CO_2$ discharged from the turbine 11. $CO_2$, of which heat is recovered while passing through the regenerator 13, is re-supplied to the heater 16.

Meanwhile, the refrigerant used to cool $CO_2$ through heat-exchanging with $CO_2$ by the heat exchanger for cooling 40 is sucked into the ejector 33 via the ejector auxiliary suction flow path 33*b*.

The refrigerant sucked into the ejector 33 passes through the second cooler 38 and the expansion valve 34 sequentially and then is separated into a refrigerant in a gas phase state and a refrigerant in a liquid phase state using the gas-liquid separator 35.

Only the refrigerant in the gas phase state separated by the gas-liquid separator 35 may be supplied to the second compressor 31. Thus, damage of the second compressor 31 may be prevented.

The refrigerant in the liquid phase state separated by the gas-liquid separator 35 may be supplied to the heat exchanger for cooling 40 so that $CO_2$ sucked into the first compressor 15 may be cooled by the heat exchanger for cooling 40.

Thus, in the power generation system having the above configuration, the ejector refrigeration unit 30 is driven using waste heat, such as the combustion gas, and a suction part of the first compressor 15 is cooled using the ejector refrigeration unit 30, and a work of the first compressor 15 is reduced so that efficiency of the entire system can be improved.

FIG. 3 is a view of a configuration of a power generation system according to another embodiment of the present invention. FIG. 4 is a view of an operating state of the power generation system illustrated in FIG. 3.

Referring to FIGS. 3 and 4, the power generation system according to another embodiment of the present invention is similar to the power generation system according to an embodiment of the present invention in that the power generation system according to another embodiment of the present invention includes a power generator 50 including a heater 56, a turbine 51, a regenerator 53, a cooler 54, and a first pressurizing module, first and second bypass flow paths 81 and 82, an ejector 73, a heat exchanger for cooling 90, and a heat source supply unit and a first working fluid sucked into the first pressurizing module is cooled using the ejector 73. However, the power generation system according to another embodiment of the present invention is different from the power generation system according to an embodiment of the present invention in that the same working fluid is used in the power generator 50 and the ejector 73 and only one compressor 55 and only one cooler 54 are used, and differences therebetween will be described in detail.

One of steam, $CO_2$, and air may be used as the first working fluid. In the current embodiment, an example in which the first working fluid is $CO_2$, will be described.

The heater 56 is a heat exchanger that heats $CO_2$ using a heat source, such as a combustion gas discharged from the turbine 51.

The turbine 51 is driven by $CO_2$ heated by and discharged from the heater 56 and generates a work. The power generator 52 is coaxially connected to the turbine 51.

The regenerator 53 is also called a heat accumulator or recuperator and serves to recover heat of $CO_2$ discharged from the turbine 51 and to heat $CO_2$ introduced into the heater 56. One side of the regenerator 53 is disposed on a cooler suction flow path 62 that connects the turbine 51 and the cooler 54, and the other side of the regenerator 53 is disposed on a compressor ejection flow path 66 that connects the compressor 55 that will be described later and the heater 56.

The cooler 54 cools $CO_2$ that has passed through the regenerator 53, using coolant. A cooler ejection flow path 64 is connected to the cooler 54.

The first pressurizing module pressurizes $CO_2$ that has passed through the first cooler 54. Because an example in which $CO_2$ is used as the first working fluid, is described, the first pressurizing module is the compressor 55 that pressurizes $CO_2$. Meanwhile, when the first working fluid is steam, a pump may be used as the first pressurizing module, and a condenser may be used as the cooler 54.

The first bypass flow path 81 is diverged from the cooler ejection flow path 64 and is formed to bypass a part of $CO_2$ discharged from the cooler 54 via the first bypass flow path 81.

An expansion valve 74 that expands $CO_2$ bypassed via the first bypass flow path 81, is installed on the first bypass flow path 81. A first flow rate control valve 91 for controlling a flow rate of bypassed $CO_2$ may be installed on the first bypass flow path 81.

The heat exchanger for cooling 90 is installed between the cooler ejection flow path 64 and the first bypass flow path 81. The heat exchanger for cooling 90 performs a heat-exchanging operation of $CO_2$ bypassed via the first bypass flow path 81 and expanded by the expansion valve 74 and $CO_2$ sucked into the compressor 44 so as to cool $CO_2$ sucked into the compressor 55.

The second bypass flow path 82 is diverged from the compressor ejection flow path 66 and is formed to bypass a part of $CO_2$ compressed by the compressor 55 via the ejector 73. A second flow rate control valve 92 for controlling a flow rate of bypassed $CO_2$ is installed on the second bypass flow path 82.

The ejector 73 sucks bypassed $CO_2$ from the second bypass flow path 82 and injects sucked $CO_2$ into a suction side of the cooler 54. The ejector 73 sucks the refrigerant that has passed through the heat exchanger for cooling 90, using $CO_2$ discharged from the compressor 55. That is, the ejector 73 injects and supplies $CO_2$ bypassed after being discharged from the compressor 55 and $CO_2$ discharged from the heat exchanger for cooling 90 into the suction side of the cooler 54. A main suction port, an auxiliary suction port, and an injection port are formed in the ejector 73. An ejector main suction flow path 73*a* is connected to the main suction port of the ejector 73, and an ejector auxiliary suction flow path 73*b* is connected to the auxiliary suction port of the ejector 73, and an ejector injection flow path 73*c* is connected to the injection port of the ejector 73. A third flow rate control valve 93 for controlling a flow rate of injected $CO_2$ may be installed on the ejector injection flow path 73*c*.

The power generation system further includes a heat source supply unit that supplies a remaining heat source after $CO_2$ is heated by the heater 56, to a suction side of the ejector 73.

The heat source supply unit includes a heat exchanger for heating 72 and a heating flow path 58.

The heat exchanger for heating 72 is installed between the ejector main suction flow path 73*a* and the heating flow path 58 and performs a heat-exchanging operation of $CO_2$ bypassed after being discharged from the compressor 55 and a heating medium discharged from the heater 56.

The heating flow path 58 connects the heater 56 and the heat exchanger for heating 72 so as to supply the heating medium discharged from the heater 56 to the heat exchanger for heating 72.

An operation according to another embodiment of the present invention having the above configuration will be described with reference to FIG. 4 as follows.

In the current embodiment, an example in which $CO_2$ is used as the working fluid, will be described. However, the present invention is not limited thereto. Of course, steam or air, etc. may be used as the working fluid.

First, $CO_2$ is heated by the heater 56 and then is supplied to the turbine 51. The heater 56 heats $CO_2$ using a heat source, such as a combustion gas generated from the outside.

The heating medium discharged from the heater 56 after $CO_2$ is heated by the heater 56, is supplied to the heat exchanger for heating 72 via the heating flow path 58.

The heat exchanger for heating 72 performs a heat-exchanging operation of the heating medium and $CO_2$ discharged from the compressor 55 and bypassed via the second bypass flow path 82 so as to heat $CO_2$ sucked into the ejector 73. $CO_2$ sucked into the ejector 73 is heated so that waste heat of the combustion gas may be sufficiently utilized.

Meanwhile, the turbine 51 is driven by $CO_2$ heated by the heater 56 and generates a work.

A part of heat of $CO_2$ discharged from the turbine 51 is recovered while passing through the regenerator 53.

$CO_2$ that has passed through the regenerator 53, is cooled while passing through the cooler 54.

A part of $CO_2$ that has passed through the cooler 54 is bypassed via the first bypass flow path 81, and the remaining part is introduced into the heat exchanger for cooling 40.

$CO_2$ bypassed via the first bypass flow path 81 is expanded by the expansion valve 74 and is introduced into the heat exchanger for cooling 90. The temperature of $CO_2$ expanded by the expansion valve 74 is lower than a temperature of $CO_2$ discharged from the cooler 54. The whole of $CO_2$ expanded by the expansion valve 74 is introduced into the heat exchanger for cooling 90.

The heat exchanger for cooling 90 performs a heat-exchanging operation of $CO_2$ on the cooler ejection flow path 64 and $CO_2$ bypassed via the first bypass flow path 81. $CO_2$ bypassed via the first bypass flow path 81 and expanded by the expansion valve 74 is used to cool $CO_2$ sucked into the compressor 55 via the cooler ejection flow path 64.

Thus, the whole of $CO_2$ sucked into the compressor 55 is cooled by the heat exchanger for cooling 90. Because the whole of $CO_2$ sucked into the compressor 55 may be cooled by the heat exchanger for cooling 90, a temperature of a suction side of the compressor 55 is lowered so that a compression work of the compressor 55 may be reduced.

When the compression work of the compressor 55 is reduced, efficiency of the entire system may be improved. Also, because a density of $CO_2$ of an inlet of the compressor is increased, a mass flow rate is increased compared to that of a compressor having the same size so that an output of the turbine 51 may be improved.

$CO_2$ cooled by the heat exchanger for cooling 90 is introduced into the compressor 55 and is compressed by the compressor 55.

A part of $CO_2$ compressed by the compressor 55 is bypassed via the second bypass flow path 92, and the remaining part is introduced into the regenerator 53.

$CO_2$ bypassed via the second bypass flow path 92 is heated while passing through the heat exchanger for heating 72 and then is sucked into the ejector 73 via the ejector main suction flow path 73*a*.

The ejector 73 sucks $CO_2$ discharged from the heat exchanger for cooling 90 from the ejector auxiliary suction flow path 73*b* using $CO_2$ sucked via the ejector main suction flow path 73*a* and then injects and supplies sucked $CO_2$ into a suction side of the cooler 54 via the ejector injection flow path 73*c*.

$CO_2$ is re-supplied to the suction side of the cooler 54 via the ejector injection flow path 73*c* so that a flow rate of $CO_2$ sucked into the compressor 55 may be secured.

In the power generation system having the configuration, the same working fluid is used in both a power generator and an ejector refrigeration unit, and only one compressor 55 and only one cooler 54 are used so that a structure of the power generation system can be simplified.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, a power generation system using an ejector refrigeration cycle in which a compression work of a compressor is reduced so that efficiency can be improved, can be manufactured.

The invention claimed is:

1. A power generation system using an ejector refrigeration cycle, the power generation system comprising:

a power generator comprising a turbine driven by a first working fluid heated by a heater, a regenerator that recovers heat of the first working fluid discharged from the turbine and delivers the recovered heat to the first working fluid introduced into the heater, a first cooler that cools the first working fluid discharged from the regenerator, and a first pressurizing module that pressurizes the first working fluid discharged from the first cooler, wherein the turbine, the regenerator, the first cooler, and the first pressurizing module are connected to one another via a first flow path; an ejector refrigeration unit comprising a second pressurizing module, an ejector that sucks and injects a second working fluid pressurized by the second pressurizing module, a second cooler that cools the second working fluid discharged from the ejector, and a gas-liquid separator that separates a refrigerant discharged from the second cooler into a refrigerant in a liquid phase state and a refrigerant in a gas phase state, wherein the second pressurizing module, the ejector, the second cooler, and the gas-liquid separator are connected to one another via a second flow path in which the second working fluid circulates;

a cooling unit configured to supply the second working fluid in the liquid phase state separated by the gas-liquid separator to a suction side of the first pressurizing module so as to cool the first working fluid sucked into the first pressurizing module and;

wherein the first and second flow paths are fluidically isolated from each other.

2. The power generation system of claim 1, wherein the cooling unit comprises:

a heat exchanger for cooling installed on a suction-side flow path of the first pressurizing module; and a cooling flow path configured to connect the gas-liquid separator and the heat exchanger for cooling, to supply the second working fluid in the liquid phase state discharged from the gas-liquid separator to the heat exchanger for cooling, and to cool the first working fluid sucked into the first pressurizing module.

3. The power generation system of claim 2, wherein the cooling unit further comprises an ejector auxiliary suction flow path configured to connect the heat exchanger for cooling and the ejector and to guide the second working fluid discharged from the heat exchanger for cooling to the ejector.

4. The power generation system of claim 1, further comprising a heat source supply unit configured to supply a remaining heat source after the first working fluid is heated by the heater, to a suction side of the ejector, wherein the heater heats the first working fluid using waste heat of a combustion gas generated from the outside.

5. The power generation system of claim 4, wherein the heat source supply unit comprises:

a heat exchanger for heating installed on an ejector main suction flow path that guides the second working fluid discharged from the second pressurizing module to the ejector; and a heating flow path configured to connect the heater and the heat exchanger for heating and to supply a heat source discharged from the heater to the heat exchanger for heating.

6. The power generation system of claim 1, wherein the first working fluid is steam.

7. The power generation system of claim 6, wherein the first pressurizing module is a pump.

8. The power generation system of claim 1, wherein the first working fluid comprises carbon dioxide ($CO_2$) or air.

9. The power generation system of claim 8, wherein the first pressurizing module is a compressor.

10. A power generation system using an ejector refrigeration cycle, the power generation system comprising:

a power generator comprising a turbine driven by steam heated by a heater, a regenerator that recovers heat of steam discharged from the turbine and delivers the recovered heat to the steam introduced into the heater, a first condenser that cools the steam discharged from the regenerator using coolant, and a pump that pumps water condensed by and discharged from the first condenser, wherein the turbine, the regenerator, the first condenser, and the pump are connected to one another via a first flow path;

an ejector refrigeration unit comprising a compressor that pressurizes a refrigerant, a heat exchanger for heating that performs a heat-exchanging operation of the refrigerant discharged from the compressor and a remaining heat source after the steam is heated by the heater, an ejector that sucks and injects the refrigerant heated by the heat exchanger for heating, a cooler that cools the refrigerant discharged from the ejector using coolant, and a gas-liquid separator that separates the refrigerant discharged from the cooler into a refrigerant in a gas phase state and a refrigerant in a liquid phase state, wherein the compressor, the heat exchanger for heating, the ejector, the cooler, and the gas-liquid separator are connected to one another via a second flow path;

a cooling flow path configured to guide the refrigerant in the liquid phase state separated by the gas-liquid separator to a suction side of the pump;

a heat exchanger for cooling installed between a suction-side flow path of the pump and the cooling flow path and configured to cool water sucked into the pump using the refrigerant in the liquid phase state that passes through the cooling flow path;

an ejector auxiliary flow path configured to connect the heat exchanger for cooling and the ejector and to guide the refrigerant in the liquid phase state discharged from the heat exchanger for cooling to an auxiliary suction port of the ejector; and wherein the first and second flow paths are fluidically isolated from each other.

11. A power generation system using an ejector refrigeration cycle, the power generation system comprising:

a power generator comprising a turbine driven by carbon dioxide (CO2) heated by a heater, a regenerator that recovers heat of CO2 discharged from the turbine and delivers recovered heat to CO2 introduced into the heater, a first cooler that cools CO2 discharged from the regenerator using coolant, and a first compressor that pressurizes CO2 cooled by the first cooler, wherein the turbine, the regenerator, the first cooler, and the first compressor are connected to one another via a first flow path;

an ejector refrigeration unit comprising a second compressor that pressurizes a refrigerant, a heat exchanger for heating that performs a heat-exchanging operation of a remaining heat source after CO2 is heated by the heater and the refrigerant discharged from the second compressor, an ejector that sucks and injects the refrigerant heated by the heat exchanger for heating, a second cooler that cools the refrigerant discharged from the ejector using coolant, and a gas-liquid separator that separates the refrigerant discharged from the second cooler into a refrigerant in a gas phase state and a refrigerant in a liquid phase state, wherein the second compressor, the heat exchanger for heating, the ejector, the second cooler, and the gas-liquid separator are connected to one another via a second flow path;

a cooling flow path configured to guide the refrigerant in the liquid phase state separated by the gas-liquid separator to a suction side of the first compressor;

a heat exchanger for cooling installed between a suction-side flow path of the first compressor and the cooling flow path and configured to cool CO2 sucked into the first compressor using the refrigerant in the liquid phase state that passes through the cooling flow path;

an ejector auxiliary flow path configured to connect the heat exchanger for cooling and the ejector and to guide the refrigerant in the liquid phase state discharged from the heat exchanger for cooling to an auxiliary suction port of the ejector; and wherein the first and second flow paths are fluidically isolated from each other.

* * * * *